US005533939A

United States Patent [19]

Martin et al.

[11] Patent Number: 5,533,939

[45] Date of Patent: Jul. 9, 1996

[54] DIGGING CHAIN

[75] Inventors: J. Scott Martin; James L. Carothers, both of Perry, Okla.

[73] Assignee: The Charles Machine Works, Inc., Perry, Okla.

[21] Appl. No.: 344,654

[22] Filed: Nov. 18, 1994

[51] Int. Cl.[6] ..... E02F 3/08

[52] U.S. Cl. ..... 474/206; 474/231; 37/465

[58] Field of Search ..... 474/206, 231, 474/901; 37/465

[56] References Cited

U.S. PATENT DOCUMENTS

| | | | |
|---|---|---|---|
| 2,374,267 | 4/1945 | Berg et al. | 474/231 X |
| 2,780,014 | 2/1957 | Arps | 37/465 X |
| 3,022,588 | 2/1962 | Brown | 37/465 |
| 3,197,040 | 7/1965 | Chapman | 37/465 X |
| 3,235,102 | 2/1966 | Chapman | 37/465 X |
| 3,344,677 | 10/1967 | Morse | 474/231 X |
| 3,979,843 | 9/1976 | Nissen | 175/89 X |
| 4,363,178 | 12/1982 | Erikson | 175/413 X |
| 4,404,761 | 9/1983 | Paulin et al. | 299/82 X |
| 4,411,131 | 10/1983 | Ohnishi et al. | 474/228 X |
| 4,704,098 | 11/1987 | Tsubakimoto | 474/206 |
| 4,757,681 | 7/1988 | Matsuno et al. | 74/581 X |
| 4,801,289 | 1/1989 | Sugimoto et al. | 474/215 |
| 4,915,511 | 4/1990 | Kotegawa et al. | 384/127 |
| 4,917,658 | 4/1990 | Sugimoto et al. | 474/242 |
| 4,995,852 | 2/1991 | Takahashi et al. | 474/91 |
| 5,009,630 | 4/1991 | Kanehira et al. | 474/211 |
| 5,026,331 | 6/1991 | Sugimoto et al. | 474/214 |

*Primary Examiner*—Rober J. Schoeppel

*Attorney, Agent, or Firm*—Richards, Medlock & Andrews

[57] ABSTRACT

A cutting chain is provided which includes facing inner side bars (12) and outside members (14) which have substantially the same height. Further, the leading inner ends of the inner side bars (12) and the trailing inner end of the outside members (14) have a reduced radius to increase wear life while giving the chain a preferred direction of travel.

10 Claims, 1 Drawing Sheet

DIGGING CHAIN

TECHNICAL FIELD OF THE INVENTION

This invention relates to the construction of a digging chain for use in ditching.

BACKGROUND OF THE INVENTION

Large roller chains with mounted cutting elements are used to dig trenches in the ground much in the same manner as a chain saw cuts wood. As can be imagined, the digging chain used to this purpose is very large and robust in order to absorb the forces necessary to dig a ditch between one and two feet wide to a depth of, for example, several feet in a single pass. The Charles Machine Works, Inc., assignee of the present application, has manufactured machinery of this type for many years.

A typical ditch digger will have an extended arm which is pivoted at its inner end to the machine. The inner end of the arm mounts a drive sprocket gear and the outer end an idler sprocket gear. A chain with suitable cutting elements or teeth is mounted between the gears and driven by the drive gear. A suitable device, such as a hydraulic ram, pivots the arm into the ground with sufficient force so that the teeth on the chain dig a trench of the desired width and depth. The device will move slowly forward as the trench is dug until the final length of the ditch is achieved.

As can well be imagined, the digging chain is an element of critical design and high wear. A need exists for constantly improving the design and service life of such a chain.

SUMMARY OF THE INVENTION

In accordance with one aspect of the present invention, a chain assembly is provided which includes a pair of facing inner side bars of predetermined height and a pair of outside members of predetermined height. The height of the inner side bars and outside members is substantially identical. A pair of rollers is positioned between the facing inner side bars and a pin connects one of said rollers to said pair of facing inner side bars and to said pair of outside members.

In accordance with another aspect of the present invention, the inner side bars have a leading (30) inside corner and a trailing (32) inside corner, the leading inside corner having a reduced radius compared to the trailing inside corner. The outside members have a leading (34) inside corner and a trailing (36) inside corner, the trailing inside corner having a reduced radius as compared to the leading inside corner. The chain assembly has a preferred direction of motion to take advantage of the greater wear life afforded by the specified radii, but will run in the reverse direction as well.

BRIEF DESCRIPTION OF THE DRAWINGS

For a more complete understanding of the present invention and for further advantages thereof, reference is now made to the following detailed description taken in conjunction with the accompanying drawings, in which.

DETAILED DESCRIPTION

Figure 1:
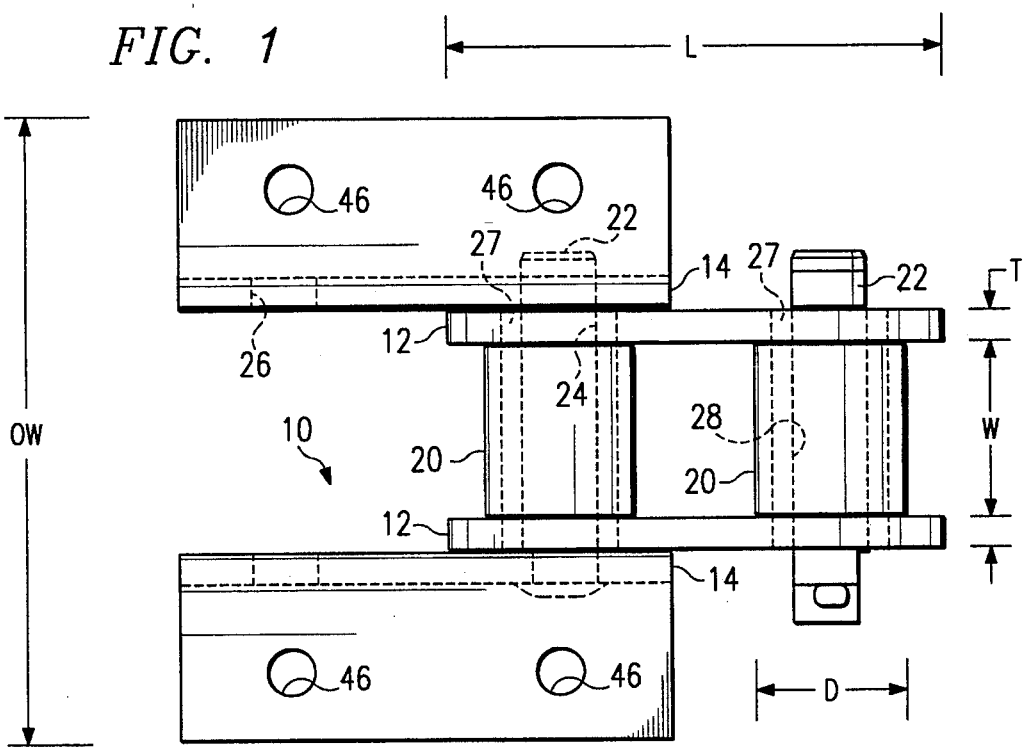
FIG. 1 is a plan view of a chain assembly forming a first embodiment of the present invention.
Figure 2:
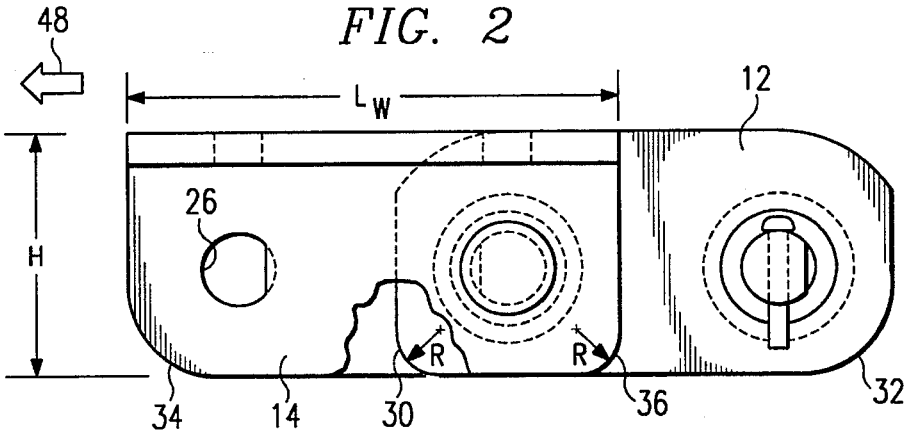
FIG. 2 is a side view of the chain assembly of FIG. 1.
Figure 3:
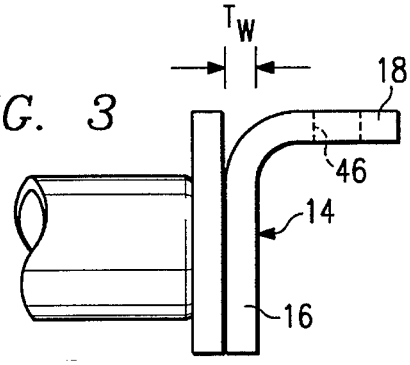
FIG. 3 is a partial end view of the chain assembly of FIG. 1.

With reference now to FIGS. 1–3, a chain assembly 10 forming a first embodiment of the present invention is illustrated. The chain assembly has a pitch selected for the particular application intended. In one chain assembly designed in accordance with the teachings of the present invention (hereinafter the prototype assembly), the pitch is four and one-half inches. Included in the chain assembly is a pair of facing inner side bars 12 and a pair of facing outside members 14. The members 14 can be K-wings (shown), M-style or any other suitable style. The inner side bars 12 have a thickness (T), length (L) and a height (H). The outside members 14 have an L shape configuration forming a chain portion 16 and a cutter mounting portion 18. Outside members 14 have a thickness ($T_W$), a length ($L_W$) and a height (H). The heights of inner side bars 12 and outside members 14 are preferably identical. Portion 18 has apertures 46 to bolt on cutting elements or teeth. In the prototype assembly, the thickness ($T_W$) of members 14 and thickness (T) of inner side bars 12 is about 0.38 inches with the length ($L_W$) of members 14 and length (L) of inner side bars 12 being about eight and one-quarter inches and the height (H) of both members 14 and inner side bars 12 being about four inches.

The chain assembly 10 also includes a pair of rollers 20 and pins 22 to hold the chain assembly together. As seen in FIG. 1, which shows a single pair of side bars 12 and members 14, a pin 22 can be seen to pass through aligned apertures 24 in side bars 12, apertures 26 in members 14, and an opening 28 in the roller to connect the various elements together. Side bars 12 have press fit bushings 27 to form apertures 24. The ends of the pin can be enlarged to hold the chain assembly together. In the prototype assembly, the diameter (D) of the rollers 20 is about two and one-quarter inches, and the rollers have a width (W) of about two inches. The side bars 12 and members 14 can also be combined with a raised rivet geometry and a heat treated lower edge to produce a higher quality chain.

The inner side bar 12 has a leading inner end 30 and a trailing inner end 32. Similarly, the members 14 have a leading inner end 34 and a trailing inner end 36. Typically, in chains available on the market, the inner ends will have a relatively large radius of curvature to permit the chain to move freely in either direction about the sprockets on which the chain is constrained. For example, a typical radius of curvature for the inner ends may be one and one-half inches. However, chain assembly 10 is provided with a leading inner end 30 and a trailing inner end 36 which have a significantly reduced radius (R), for example, 0.62 inches. The radius of ends 32 and 34 can remain one and one-half inches.

The design of chain assembly 10 has several important features. One feature is making the height of the inner side bars 12 approximately equal to the height of the outside members 14, including even the cutter mounting portion 18. This provides better back-flex capability. Another important feature is the reduced diameter in the leading inner end of the inner side bars and the trailing inner end of the outside members. By reducing the radius, additional material can be added to the corners to increase the wear life of the chain assembly. This design gives the chain assembly a preferred direction of movement, represented by arrow 48 in FIG. 2, although movement in the opposite direction is possible. However, having a chain with a preferred direction of movement is usually not a draw back as the cutters mounted on the chain assembly will only cut as the chain moves in a single direction and it is necessary only to insure that the chain assembly is put in the right orientation over the sprockets so that the chain assembly moves in the proper direction for cutting. The improvement will mean a longer life for the chain assembly and improve the anti-back flex capability of the chain assembly. Therefore productivity is enhanced.

Making the inner side bars the same height of the outside members is particularly helpful in providing surface for back flex load control. The pitch of the prototype chain assembly is about four and one-half inches while the 15-tooth drive sprocket pitch diameter is about twenty to twenty-two inches and the overall width (OW) is about nine inches.

In a second prototype assembly constructed in accordance with the teachings of the present invention, the inner side bars of chain assembly have a thickness (T) of about 0.62 inches, a length (L) of about eight and one-quarter inches and a height (H) of about 4.12 inches. The outside members 14 have a thickness ($T_W$) of about 0.62 inches, a length ($L_W$) of about eight and one-quarter inches and a height (H) of about 4.12 inches. The rollers each have a diameter (D) of about two and one-half inches and a width (W) of about 2 and three-quarter inches. The pins have a diameter of about one and one-quarter inches. The leading inner end 30 and trailing inner end 36 have a radius of 0.62 inches while the radius of inner ends 32 and 34 is one and one-half inches. The chain pitch is 4.5 inches.

While a single embodiment of the invention has been described in the foregoing description and illustrated in the accompanying drawings, it will be understood that the invention is not limited to the embodiment disclosed, but is capable of numerous re-arrangements, modifications and substitutions of parts and elements without departing from the spirit and scope of the invention.

We claim:

1. A chain assembly for use with a cutting element, comprising:

a pair of facing inner side bars of predetermined height, the inner side bars having a leading inner end of a first radius and a trailing inner end of a second radius, the first radius being smaller than the second radius;

a pair of outside members of predetermined height, the outside members having a leading inner end of third predetermined radius and a trailing inner end of fourth predetermined radius, the fourth predetermined radius being smaller than the third predetermined radius, the pair of outside members having a mounting portion to mount a cutting element thereon;

a pair of rollers positioned between said facing inner side bars; a pin connecting one of said rollers to said pair of facing inner side bars and to said pair of outside members.

2. The chain assembly of claim 1 wherein the members are K-wings.

3. The chain assembly of claim 1 wherein the leading inner ends of the inner side bars and the trailing inner ends of the outside members have a sufficiently small radius to cause the chain assembly to have a preferred direction of movement.

4. The chain assembly of claim 3 wherein the radius of the ends is about 0.62 inches with a pitch of about 4.5 inches.

5. The chain assembly of claim 1, wherein the first and fourth radius are 0.62" and the second and third radius are 1.5".

6. The chain assembly of claim 1, wherein the ratio of the second radius to the first radius is about three to one.

7. A chain assembly, comprising:

a pair of facing inner side bars of predetermined height;

a pair of outside members of predetermined height;

a pair of rollers positioned between said facing inner side bars;

a pin connecting one of said rollers to said pair of facing inner side bars and said pair of outside members;

each of the facing inner side bars having a leading inner end and each of the outside members having a trailing inner end, the ends having a sufficiently small radius to establish a preference in direction of movement of the chain assembly.

8. The chain assembly of claim 7 wherein the height of the facing inner side bars and outside members is substantially identical.

9. The chain assembly of claim 7 having a chain pitch of about four and one-half inches.

10. A method of forming a digging chain assembly for mounting digging elements thereon, comprising the steps of:

forming the leading inner ends of a pair of facing inner side bars of predetermined height and the trailing inner ends of a pair of outside members of predetermined height to maximize the available wear surface area between the leading inner end and the trailing inner end of each bar and member to increase the service life of the chain assembly;

designing the leading inner ends of the outside members and the trailing inner ends of the inner side bars to provide for ease of direction of the movement of the chain assembly in the direction so that the leading inner end of each bar and member precedes the inner trailing end thereof.

* * * * *